US007955233B1

(12) United States Patent
Wu

(10) Patent No.: US 7,955,233 B1
(45) Date of Patent: Jun. 7, 2011

(54) ABDOMEN EXERCISING DEVICE THAT IS OPERATED SAFELY

(75) Inventor: Dong-Her Wu, Changhua Hsien (TW)

(73) Assignee: Twinsonic Enterprise Co., Ltd., Changhua Hsien (TW)

( * ) Notice: Subject to any disclaimer, the term of this patent is extended or adjusted under 35 U.S.C. 154(b) by 0 days.

(21) Appl. No.: 12/795,749

(22) Filed: Jun. 8, 2010

(51) Int. Cl.
*A63B 21/00* (2006.01)

(52) U.S. Cl. ..... 482/101; 482/907; 482/141

(58) Field of Classification Search ..... 482/482, 482/121, 126, 907, 95.96
See application file for complete search history.

(56) References Cited

U.S. PATENT DOCUMENTS 5,295,935 A * 3/1994 Wang ..... 482/130
5,518,483 A * 5/1996 Oswald ..... 482/131
D419,625 S * 1/2000 Barnett et al. ..... D21/692
D425,585 S * 5/2000 Wu ..... D21/676
6,071,217 A * 6/2000 Barnett ..... 482/121
6,196,954 B1 * 3/2001 Chen ..... 482/131
7,662,076 B1 * 2/2010 Ho ..... 482/130

* cited by examiner

*Primary Examiner* — Jerome W Donnelly
(74) *Attorney, Agent, or Firm* — Alan Kamrath; Kamrath & Associates PA

(57) ABSTRACT

An abdomen exercising device includes a soft cushion, a base combined with the cushion, a sliding unit slidably mounted on the base, an elastic cord biased between the base and the sliding unit to provide a damping force to the sliding unit and a top cover mounted on the base to cover the elastic cord and to partially cover the sliding unit. Thus, the parts of the abdomen exercising device are almost hidden between and covered by the base and the top cover to prevent the user from being clamped or scratched by the elastic cord or the sliding unit during the exercising process so as to protect the user's safety.

16 Claims, 13 Drawing Sheets

ABDOMEN EXERCISING DEVICE THAT IS OPERATED SAFELY

BACKGROUND OF THE INVENTION

1. Field of the Invention

The present invention relates to an exercising device and, more particularly, to an abdomen exercising device that is operated by pushing and pulling actions intermittently.

2. Description of the Related Art

A conventional abdomen exercising device in accordance with the prior art shown in FIGS. 13 and 14 comprises a support unit 60 and a sliding unit 70 slidably mounted on the support unit 60. The support unit 60 includes two transverse guide rods 61 parallel with each other, two stop members 62 and 63 mounted between the two guide rods 61 to space the two guide rods 61 from each other and two stands 64 and 65 mounted on two opposite ends of a lower one of the two guide rods 61 to elevate the two guide rods 61. The sliding unit 70 includes two rollers 71 each rotatably mounted between the two guide rods 61 and each limited between the two stop members 62 and 63, a moving bracket 75 movably mounted between the two guide rods 61 and connected with the two rollers 71 to carry the two rollers 71, a shaft 72 extending through the moving bracket 75 to move the moving bracket 75 relative to the two guide rods 61, two handgrips 73 mounted on two opposite ends of the shaft 72 to move the shaft 72 and an elastic cord 74 biased between one of the two stop members 62 and 63 of the support unit 60 and the moving bracket 75 to provide a damping force to the moving bracket 75.

In operation, a user is kneeled on the ground with his two hands holding the two handgrips 73 of the sliding unit 70. In such a manner, the user's body is moved forward and backward to push and pull the sliding unit 70 reciprocally so as to exercise the user's abdomen, waist and hip. At this time, the elastic cord 74 is tensioned during movement of the sliding unit 70 to provide a damping force to the sliding unit 70 so as to enhance the exercising effect.

However, the moving bracket 75, the rollers 71, the shaft 72 and the elastic cord 74 are exposed outward from the two guide rods 61 so that a user is easily clamped or scratched by the exposing parts of the abdomen exercising device. In addition, the two rollers 71 are exposed outward from the two guide rods 61 so that dust or foreign substances is easily attached to the rollers 71 to wear or rust the rollers 71 during a long-term utilization. Further, the two guide rods 61 are long and cannot be folded so that the abdomen exercising device has a larger volume, thereby causing inconvenience in packaging, storage and transportation of the abdomen exercising device. Further, the tension of the elastic cord 74 cannot be adjusted so that the user has to replace the elastic cord 74 to have a different tension, thereby increasing the cost. Further, the user's body directly touches the two guide rods 61 during the exercising process so that the user is easily hurt by the two guide rods 61.

BRIEF SUMMARY OF THE INVENTION

In accordance with the present invention, there is provided an abdomen exercising device, comprising a soft cushion, a base combined with the cushion, a sliding unit slidably mounted on the base, an elastic cord biased between the base and the sliding unit to provide a damping force to the sliding unit and a top cover mounted on the base to cover the elastic cord and to partially cover the sliding unit.

The base has a platform. The platform of the base has a top face formed with two opposite first support rails and a receiving space defined between the two first support rails. Each of the two first support rails of the platform extends upward and has a top formed with a first slideway. The abdomen exercising device further comprises a support rod rotatably mounted in the receiving space of the platform. The top cover has a bottom face formed with two opposite second support rails aligning with the two first support rails of the platform respectively. Each of the two second support rails of the top cover has a bottom formed with a second slideway aligning with the first slideway of a respective one of the two first support rails. The top cover has two opposite sides each formed with a cutout. The sliding unit includes a shaft movably mounted between the base and the top cover and having two opposite ends each extending through and protruding outward from the cutout of the top cover, a movable rod rotatably mounted on the shaft and received in the receiving space of the platform, two rollers each rotatably mounted on the shaft and each movable in the first slideway of a respective one of the two first support rails and the second slideway of a respective one of the two second support rails, and two handgrips mounted on the two opposite ends of the shaft respectively and protruding outward from the base and the top cover. The elastic cord passes through and is wound around the support rod and the movable rod of the sliding unit. The elastic cord has two distal ends secured on the platform of the base.

The primary objective of the present invention is to provide an abdomen exercising device that is operated safely to protect a user's safety.

According to the primary advantage of the present invention, only the two handgrips of the sliding unit protrude outward from the base and the top cover so that the parts of the abdomen exercising device are almost hidden between and covered by the base and the top cover to prevent the user from being clamped or scratched by the elastic cord, the movable rod or the rollers during the exercising process so as to protect the user's safety.

According to another advantage of the present invention, the parts of the abdomen exercising device are almost hidden between and covered by the base and the top cover to prevent dust or foreign substances from being attached to the rollers so that the rollers will not be rusted or worn out during a long-term utilization.

According to a further advantage of the present invention, the cushion is foldable to reduce the whole volume of the abdomen exercising device so as to facilitate packaging, storage and transportation of the abdomen exercising device.

According to a further advantage of the present invention, the user only needs to remove the top cover from the base to adjust the tension of the elastic cord easily and quickly without having to replace the elastic cord.

According to a further advantage of the present invention, each of the rollers is guided by the first slideway of the respective first support rail and the second slideway of the respective second support rail so that the rollers are moved smoothly and stably so as to facilitate operation of the abdomen exercising device.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
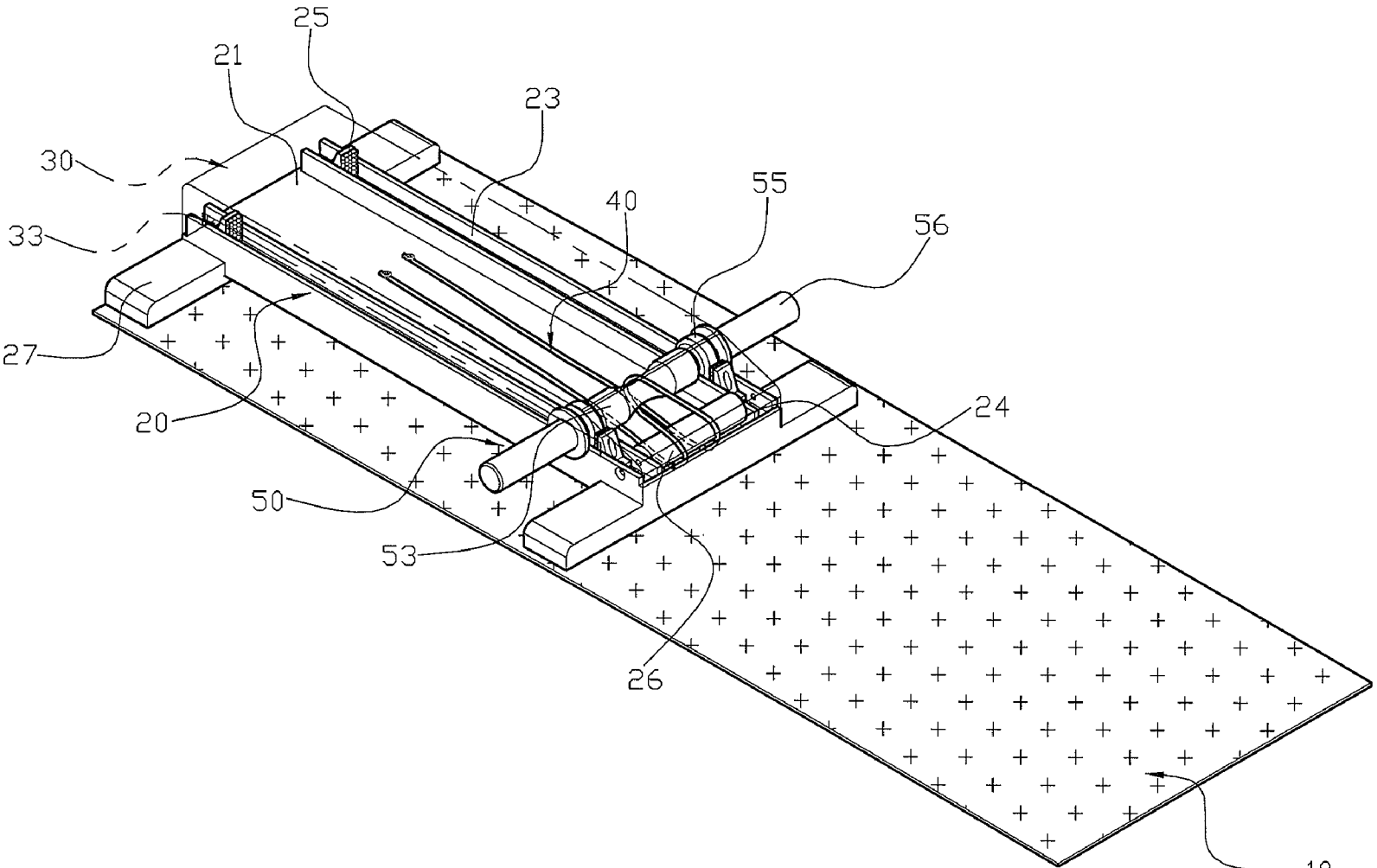
FIG. 1 is a perspective view of an abdomen exercising device in accordance with the preferred embodiment of the present invention.
Figure 2:
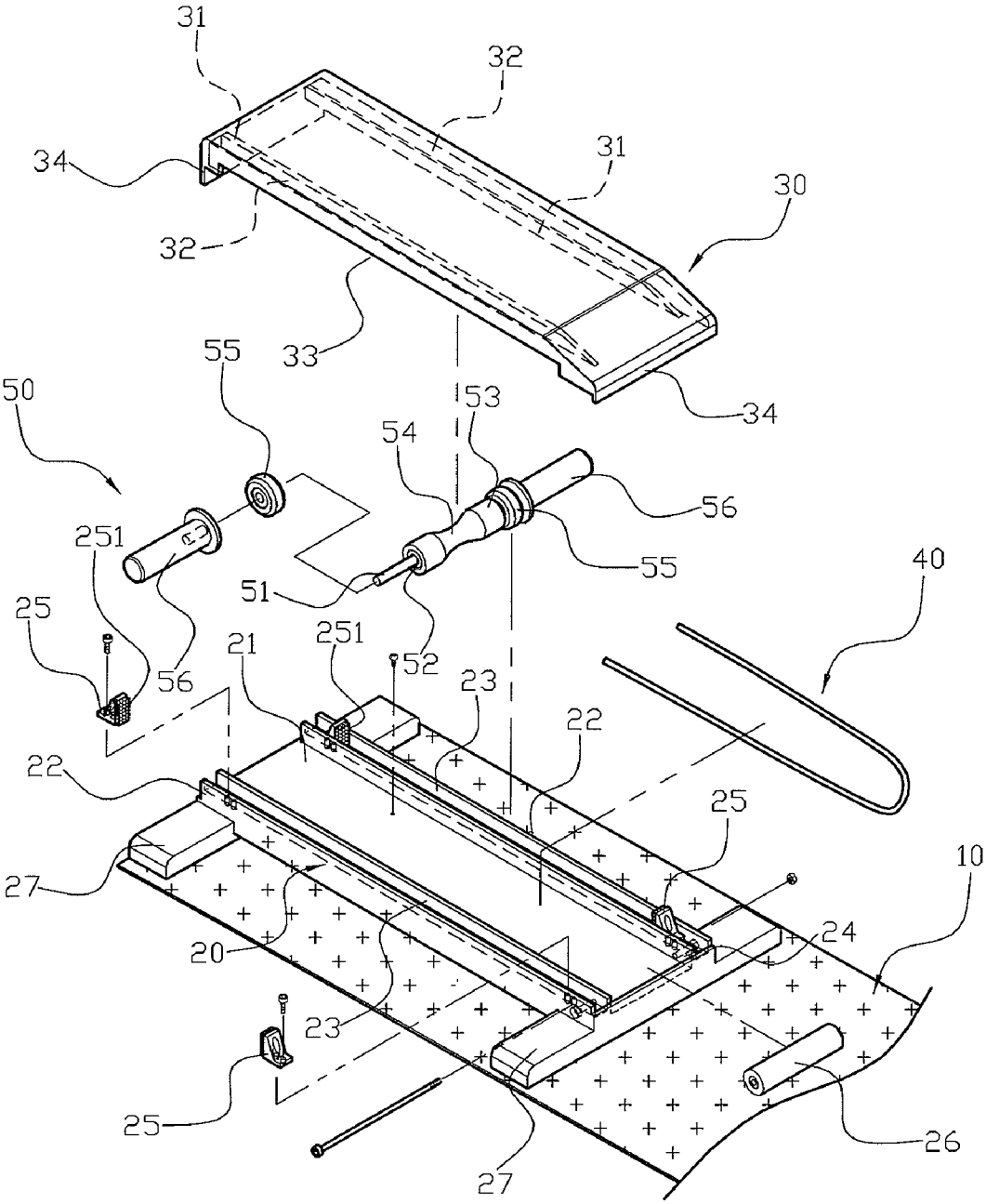
FIG. 2 is an exploded perspective view of the abdomen exercising device as shown in FIG. 1.
Figure 3:
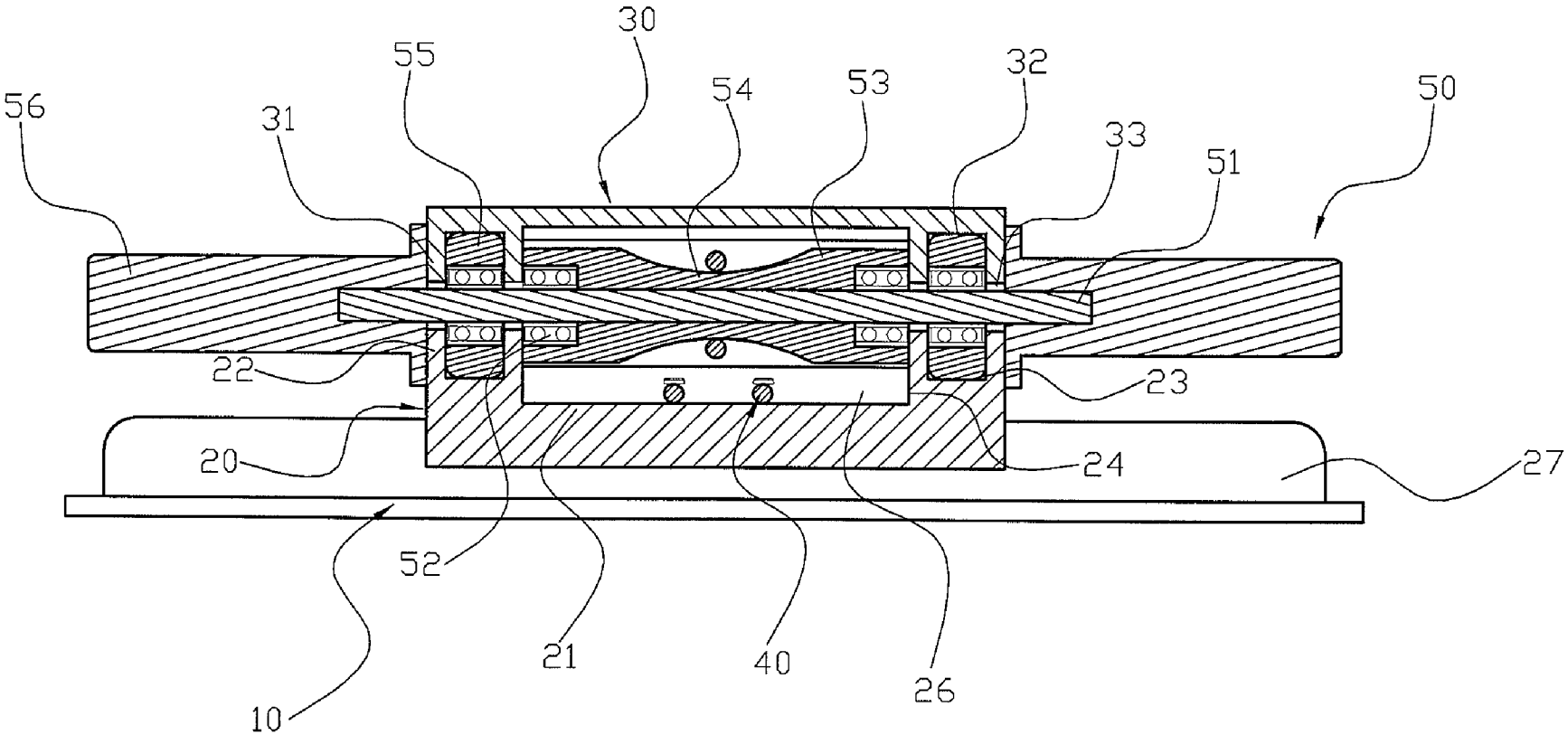
FIG. 3 is a side cross-sectional view of the abdomen exercising device as shown in FIG. 1.
Figure 4:
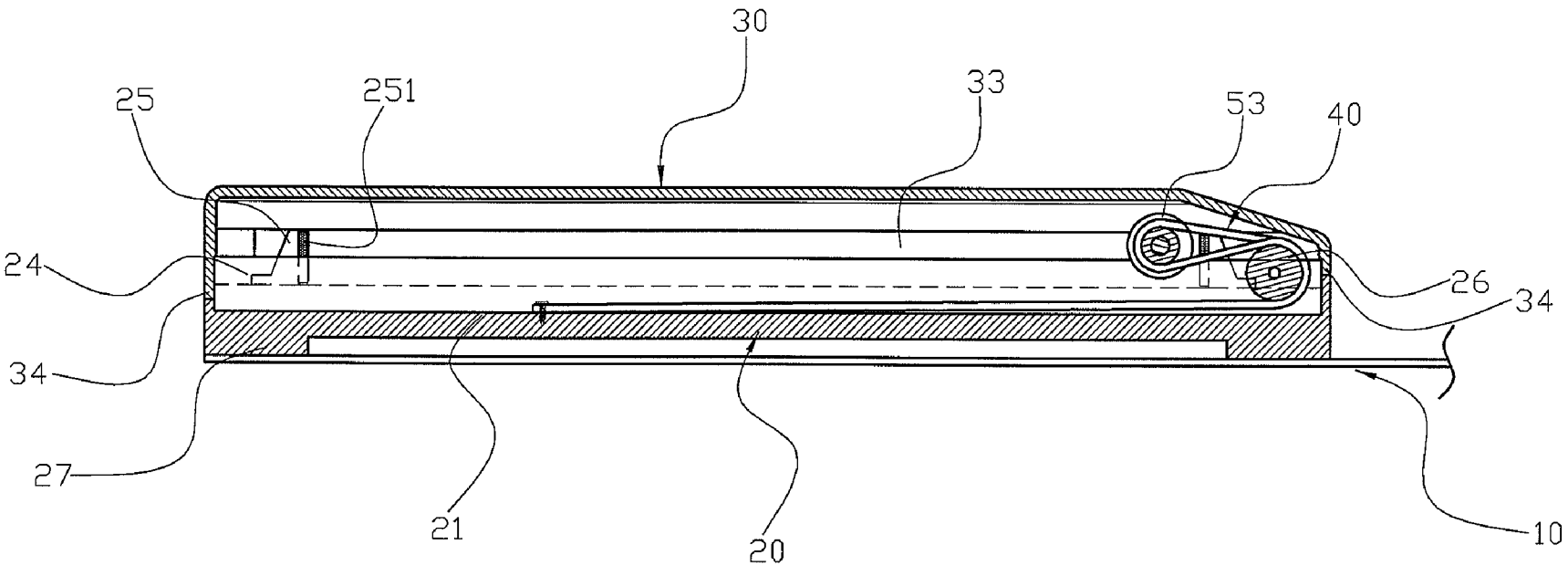
FIG. 4 is a front cross-sectional view of the abdomen exercising device as shown in FIG. 1.

Referring to the drawings and initially to FIGS. 1-8, an abdomen exercising device in accordance with the preferred embodiment of the present invention comprises a soft cushion 10, a base 20 combined with the cushion 10, a sliding unit 50 slidably mounted on the base 20, an elastic cord 40 biased between the base 20 and the sliding unit 50 to provide a damping force to the sliding unit 50 and a top cover 30 mounted on the base 20 to cover the elastic cord 40 and to partially cover the sliding unit 50.

The cushion 10 is made of a resilient material so as to provide a shock-absorbing effect. The cushion 10 is foldable to reduce the whole volume of the abdomen exercising device.

The base 20 is mounted on a top of the cushion 10. The base 20 has a platform 21. The platform 21 of the base 20 has a top face formed with two opposite first support rails 22 and a receiving space 24 defined between the two first support rails 22. Each of the two first support rails 22 of the platform 21 extends upward and has a top formed with a first slideway 23. The abdomen exercising device further comprises a support rod 26 rotatably mounted in the receiving space 24 of the platform 21. The support rod 26 is covered by the top cover 30. The first slideway 23 of each of the two first support rails 22 is provided with two opposite stop blocks 25 and two opposite buffer pads 251 mounted on the two stop blocks 25 respectively. The two buffer pads 251 of each of the two first support rails 22 face toward each other to provide stopping, vibration reduction and noise suppression effects. The base 20 has a bottom provided with two opposite stands 27 to elevate the base 20.

The top cover 30 has a bottom face formed with two opposite second support rails 31 aligning with the two first support rails 22 of the platform 21 respectively. Each of the two second support rails 31 of the top cover 30 has a bottom formed with a second slideway 32 aligning with the first slideway 23 of a respective one of the two first support rails 22. The top cover 30 has two opposite sides each formed with a cutout 33. The top cover 30 has two opposite ends each formed with a downward extending sealing plate 34 resting on two opposite ends of the base 20.

The sliding unit 50 includes a shaft 51 movably mounted between the base 20 and the top cover 30 and having two opposite ends each extending through and protruding outward from the cutout 33 of the top cover 30, a movable rod 53 rotatably mounted on the shaft 51 and received in the receiving space 24 of the platform 21, two rollers 55 each rotatably mounted on the shaft 51 and each movable in the first slideway 23 of a respective one of the two first support rails 22 and the second slideway 32 of a respective one of the two second support rails 31, and two handgrips 56 mounted on the two opposite ends of the shaft 51 respectively and protruding outward from the base 20 and the top cover 30. The shaft 51, the movable rod 53 and the two rollers 55 of the sliding unit 50 are covered by the top cover 30. The movable rod 53, the two rollers 55 and the two handgrips 56 of the sliding unit 50 are spaced from each other. The movable rod 53 of the sliding unit 50 is disposed between the two first support rails 22 of the platform 21 and between the two second support rails 31 of the top cover 30. The movable rod 53 has two opposite ends each rotatably mounted on the shaft 51 by a bearing 52. The movable rod 53 has a periphery formed with a limit groove 54. The two handgrips 56 of the sliding unit 50 protrude outward from the two first support rails 22 of the platform 21 respectively and protrude outward from the two second support rails 31 of the top cover 30 respectively. Each of the two rollers 55 of the sliding unit 50 is limited between the two stop blocks 25 of each of the two first support rails 22.

The elastic cord 40 is made of a weaving strap or a rubber cord and is received in the receiving space 24 of the platform 21. The elastic cord 40 passes through and is wound around the support rod 26 and the movable rod 53 of the sliding unit 50. The elastic cord 40 is wound around the limit groove 54 of the movable rod 53. The elastic cord 40 has two distal ends secured on the platform 21 of the base 20. In assembly, a first one of the two distal ends of the elastic cord 40 is secured on the platform 21 of the base 20, and a second one of the two distal ends of the elastic cord 40 is initially wound around the support rod 26, then wound around the movable rod 53 of the sliding unit 50, then wound around the support rod 26 and is finally secured on the platform 21 of the base 20.

Figure 5:
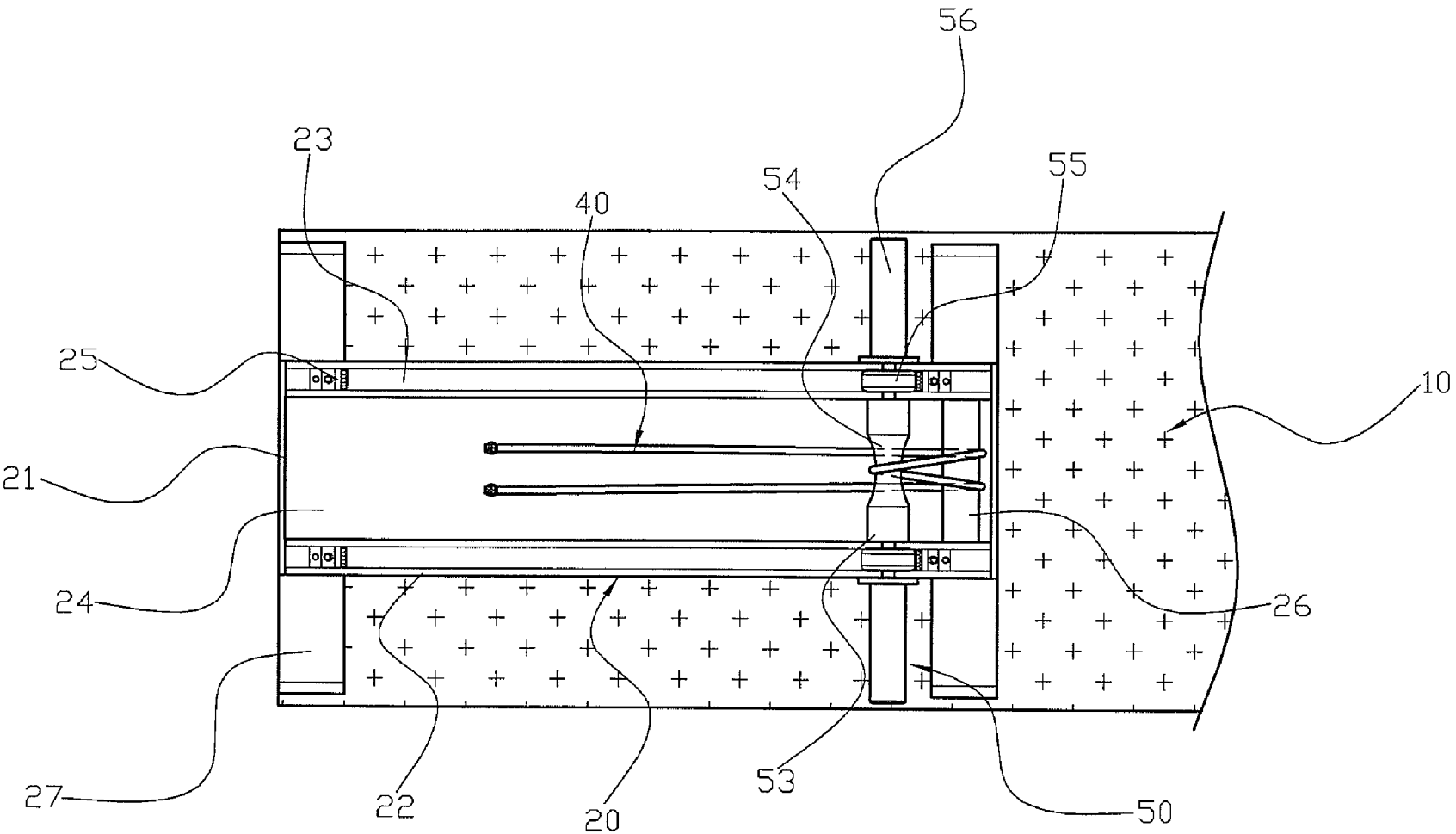
FIG. 5 is a partially top view of the abdomen exercising device as shown in FIG. 1.
Figure 6:
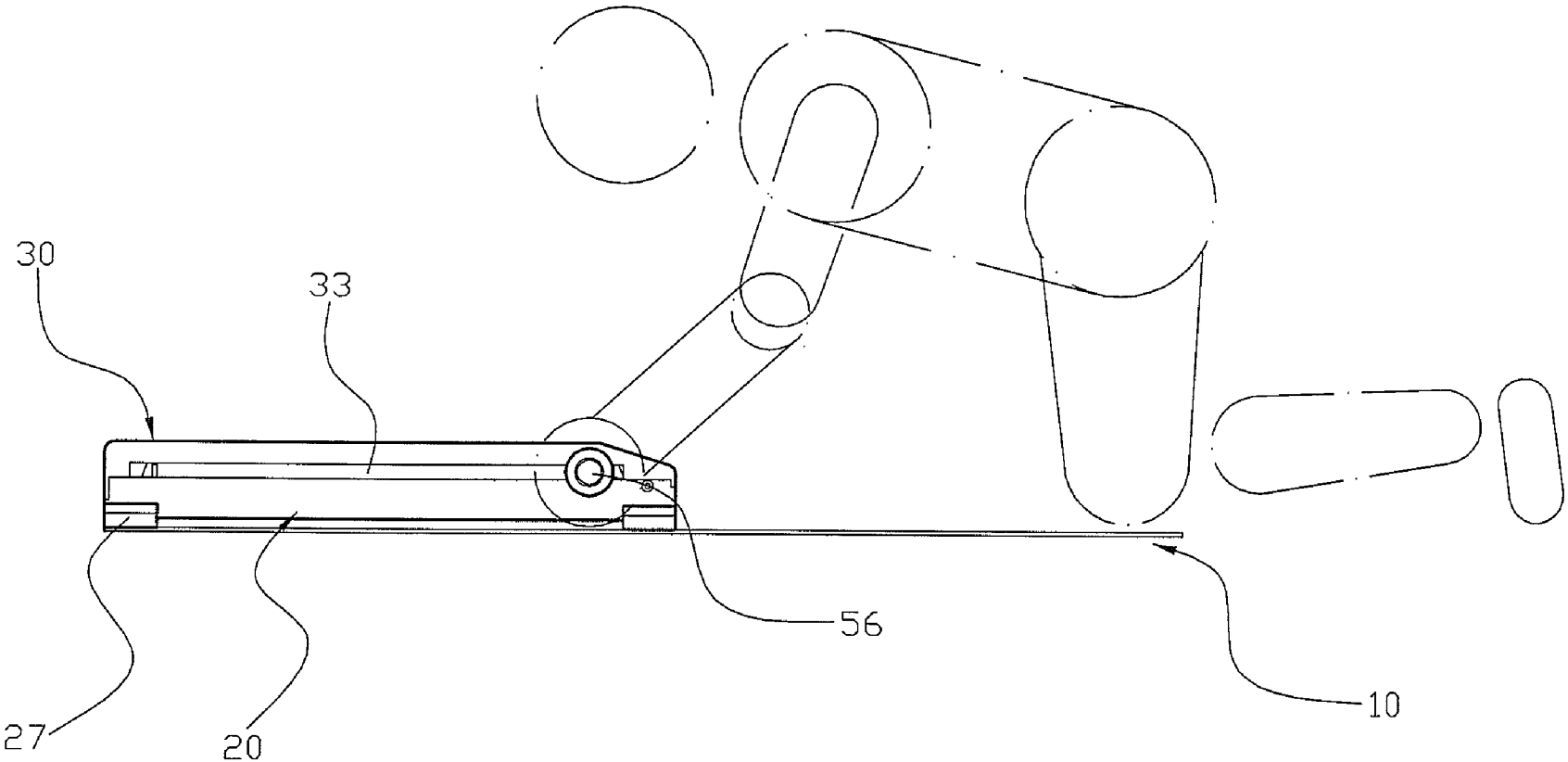
FIG. 6 is a schematic front operational view of the abdomen exercising device as shown in FIG. 1.
Figure 7:
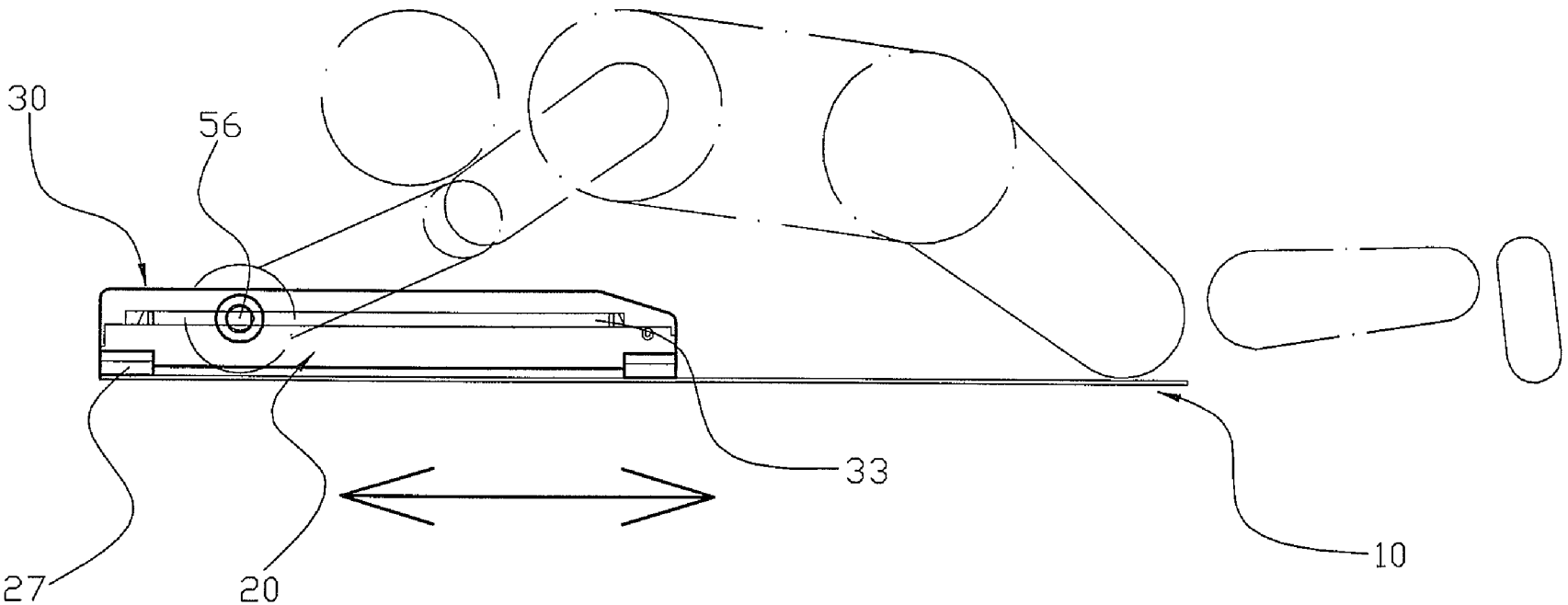
FIG. 7 is a schematic front operational view of the abdomen exercising device as shown in FIG. 6.
Figure 8:
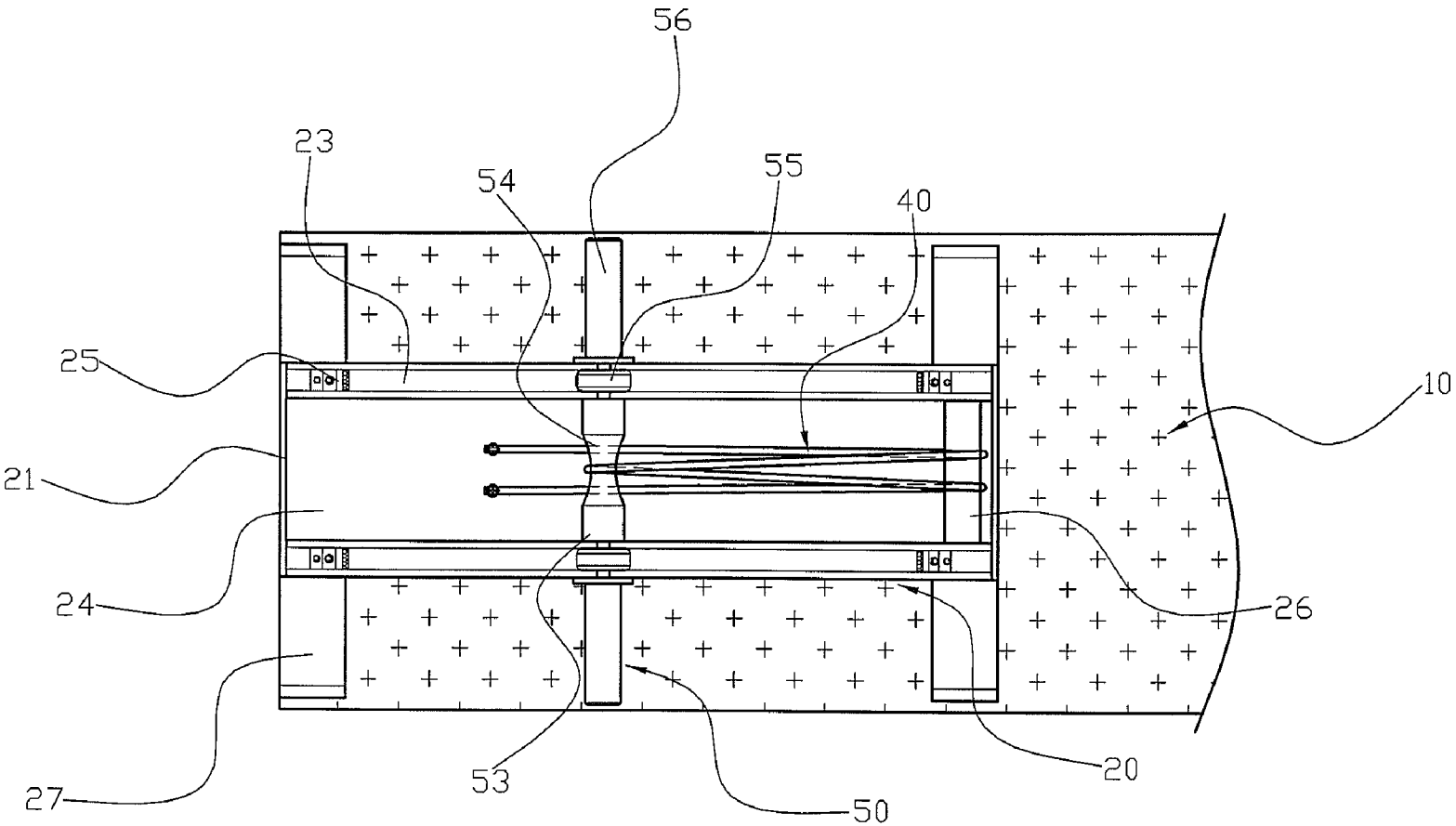
FIG. 8 is a schematic front operational view of the abdomen exercising device as shown in FIG. 5.

In operation, referring to FIGS. 5-8 with reference to FIGS. 1-4, a user is kneeled on the cushion 10 with his two hands holding the two handgrips 56 of the sliding unit 50. In such a manner, the user's body is moved forward and backward as shown in FIGS. 6 and 7 to push and pull the sliding unit 50 reciprocally so as to exercise the user's abdomen, waist and hip. At this time, the elastic cord 40 is tensioned during movement of the sliding unit 50 as shown in FIGS. 5 and 8 to provide a damping force to the sliding unit 50 so as to enhance the exercising effect.

Figures 9, 10:
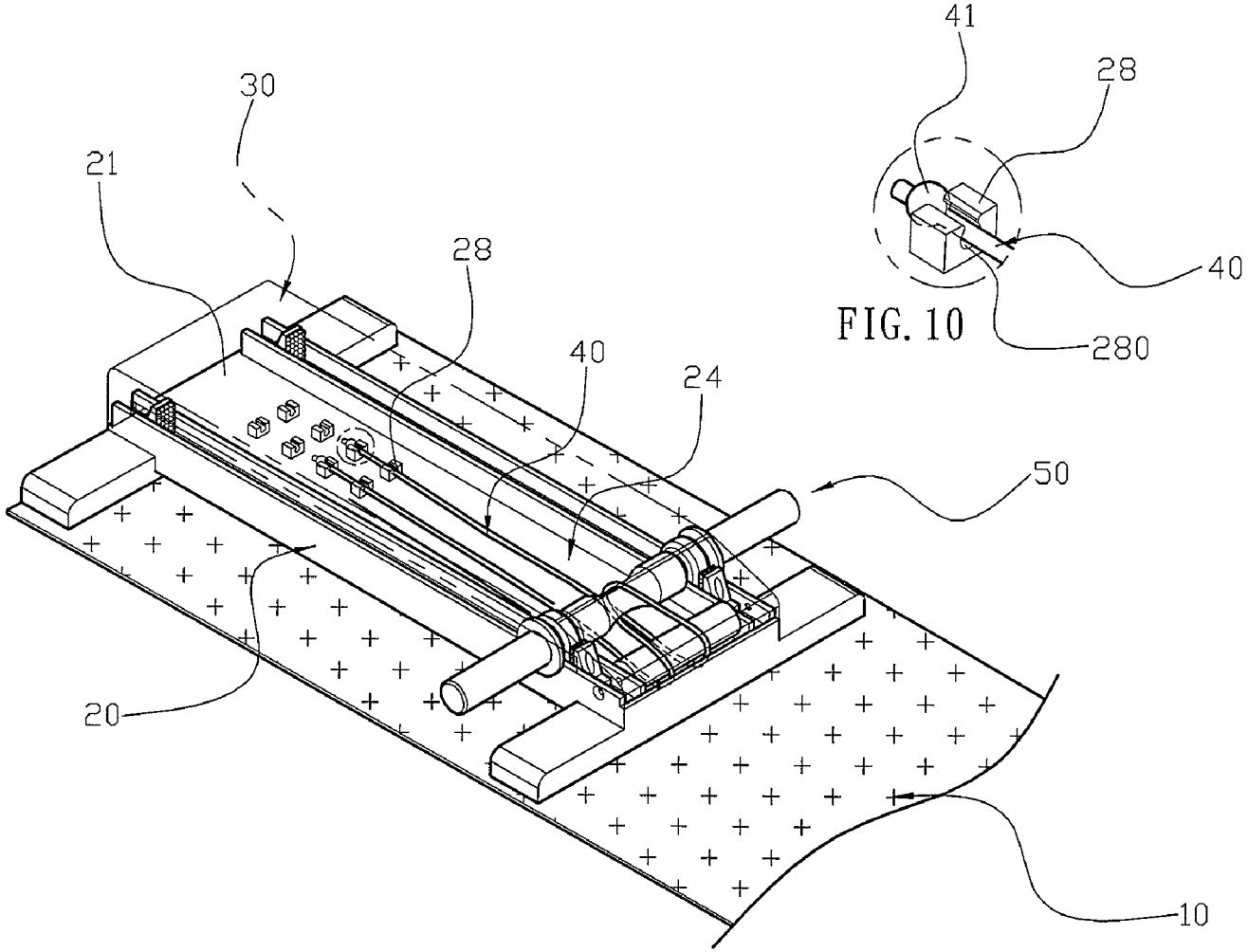
FIG. 9 is a perspective view of an abdomen exercising device in accordance with another preferred embodiment of the present invention.
FIG. 10 is a locally perspective enlarged view of the abdomen exercising device as shown in FIG. 9.
Figure 11:
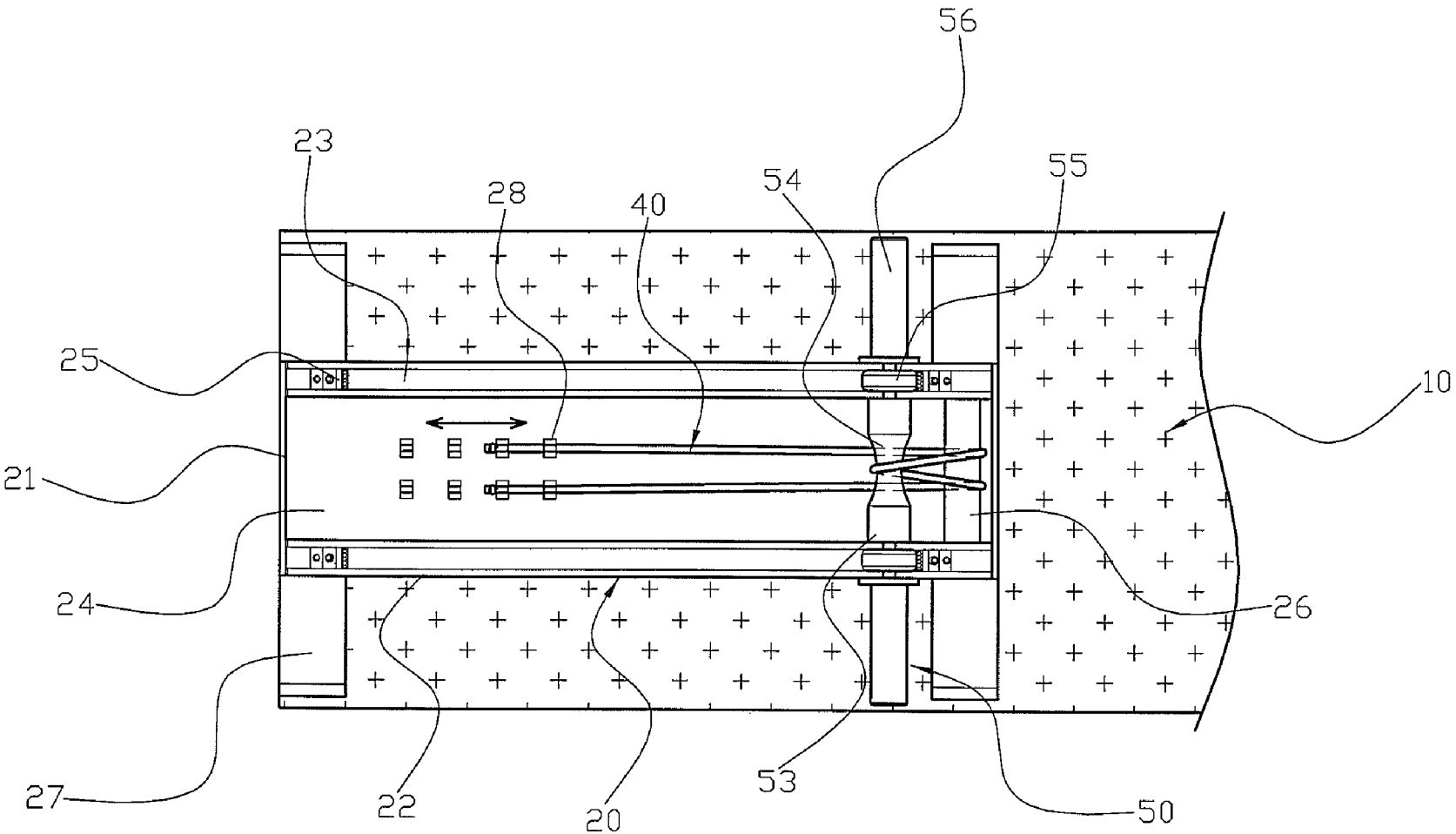
FIG. 11 is a partially top view of the abdomen exercising device as shown in FIG. 10.

Referring to FIGS. 9-11, the abdomen exercising device further comprises a plurality of tension adjusting seats 28 mounted on the platform 21 of the base 20, and the two distal ends of the elastic cord 40 are adjustably mounted on the tension adjusting seats 28 respectively. The tension adjusting seats 28 are received in the receiving space 24 of the platform 21 and are spaced from each other with a determined interval defined therebetween to adjust the tension of the elastic cord 40. Each of the tension adjusting seats 28 has a substantially U-shaped profile and has a top formed with an arcuate retaining groove 280 to receive the elastic cord 40. Each of the two distal ends of the elastic cord 40 is provided with an enlarged head 41 abutting a side of the respective tension adjusting seat 28. The enlarged head 41 of the elastic cord 40 has a size greater than that of the retaining groove 280 of the respective tension adjusting seat 28.

Figure 12:
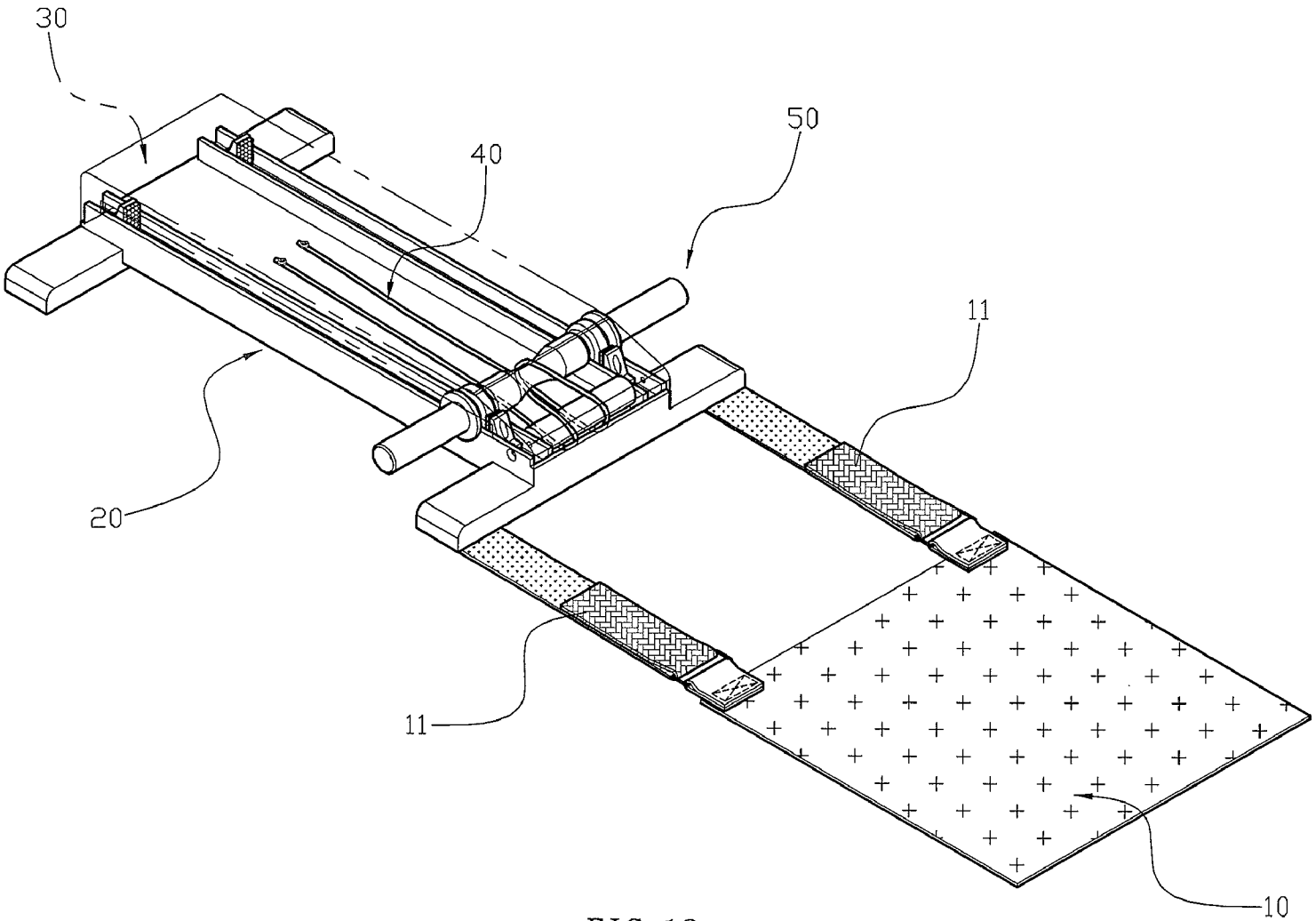
FIG. 12 is a perspective view of an abdomen exercising device in accordance with another preferred embodiment of the present invention.
Figure 13:
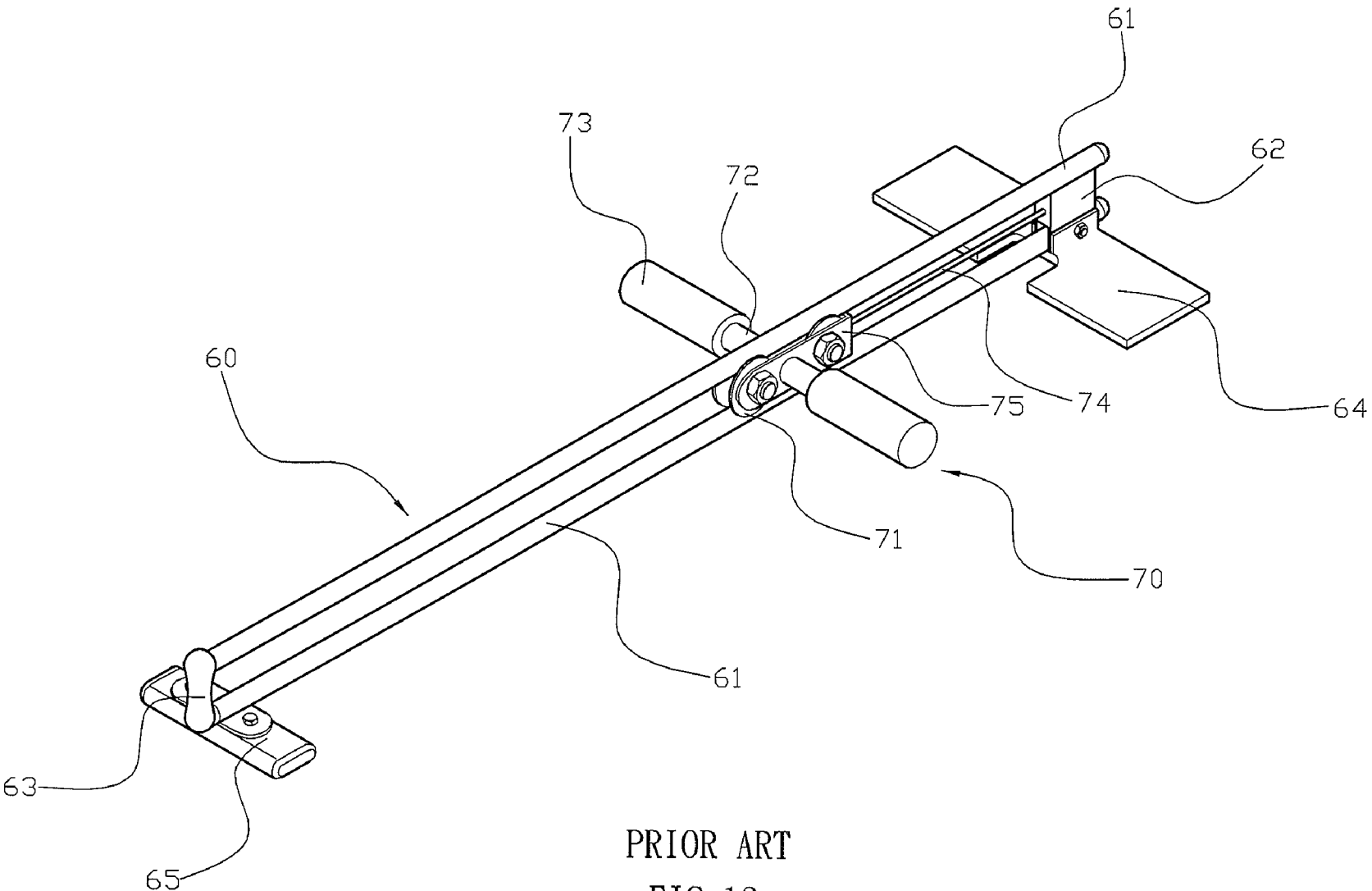
PRIOR ART FIG. 13
FIG. 13 is a perspective view of a conventional abdomen exercising device in accordance with the prior art.
Figure 14:
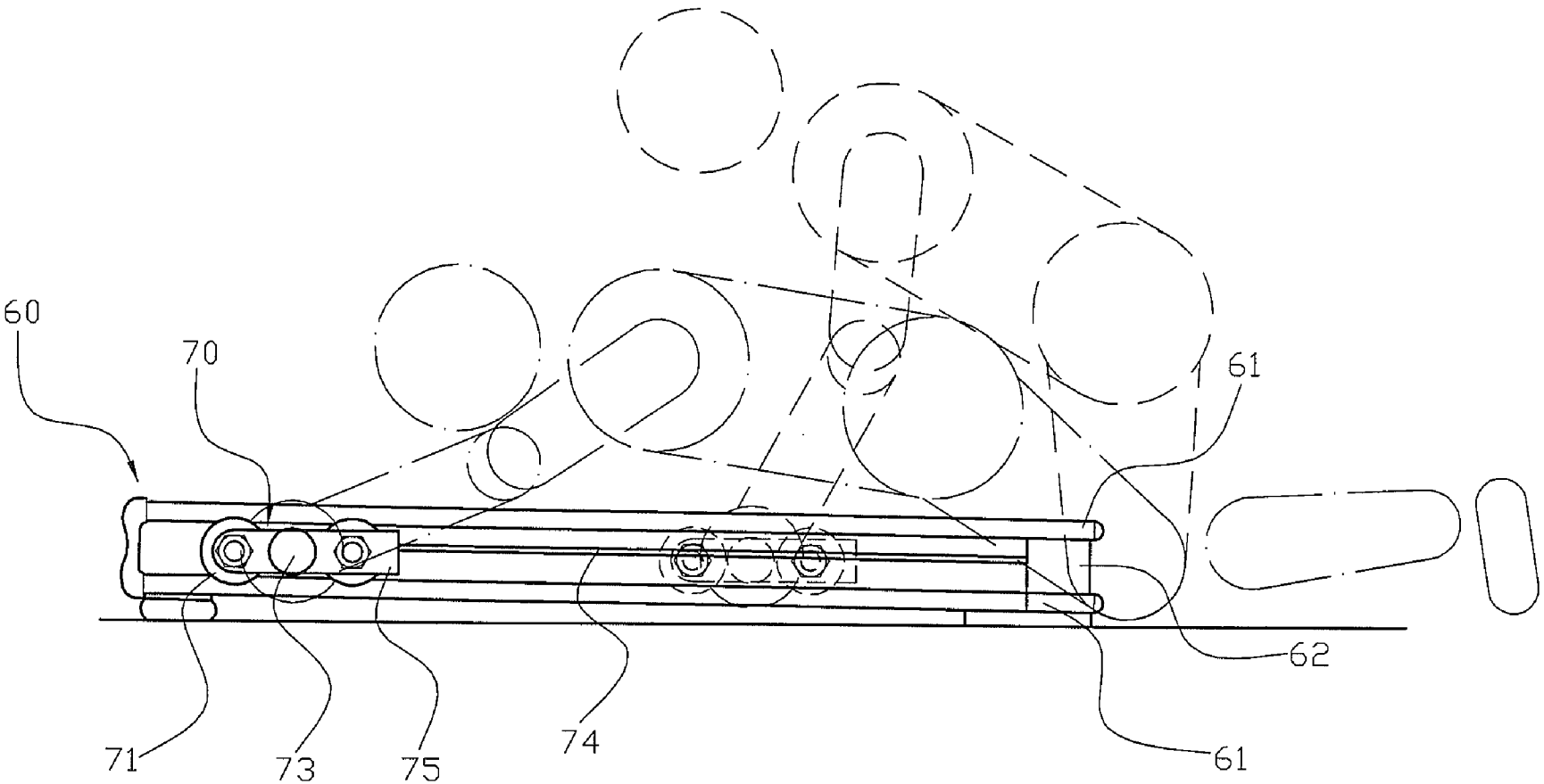
PRIOR ART FIG. 14
FIG. 14 is a schematic front operational view of the conventional abdomen exercising device as shown in FIG. 13.

Referring to FIG. 12, the base 20 is spaced from the cushion 10, and the abdomen exercising device further comprises at least one connecting member 11 connected between the base 20 and the cushion 10 to connect the base 20 with the cushion 10. The connecting member 11 is made of an elongate weaving strap and has an adjustable length.

Accordingly, only the two handgrips 56 of the sliding unit 50 protrude outward from the base 20 and the top cover 30 so that the parts of the abdomen exercising device are almost hidden between and covered by the base 20 and the top cover 30 to prevent the user from being clamped or scratched by the elastic cord 40, the movable rod 53 or the rollers 55 during the exercising process so as to protect the user's safety. In addition, the parts of the abdomen exercising device are almost hidden between and covered by the base 20 and the top cover 30 to prevent dust or foreign substances from being attached to the rollers 55 so that the rollers 55 will not be rusted or worn out during a long-term utilization. Further, the cushion 10 is foldable to reduce the whole volume of the abdomen exercising device so as to facilitate packaging, storage and transportation of the abdomen exercising device. Further, the user only needs to remove the top cover 30 from the base 20 to adjust the tension of the elastic cord 40 easily and quickly without having to replace the elastic cord 40. Further, each of the rollers 55 is guided by the first slideway 23 of the respective first support rail 22 and the second slideway 32 of the respective second support rail 31 so that the rollers 55 are moved smoothly and stably so as to facilitate operation of the abdomen exercising device.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An abdomen exercising device, comprising:

a soft cushion;

a base combined with the cushion;

a sliding unit slidably mounted on the base;

an elastic cord biased between the base and the sliding unit to provide a damping force to the sliding unit; and a top cover mounted on the base to cover the elastic cord and to partially cover the sliding unit;

wherein the base has a platform;

the platform of the base has a top face formed with two opposite first support rails and a receiving space defined between the two first support rails;

each of the two first support rails of the platform extends upward and has a top formed with a first slideway;

the abdomen exercising device further comprises a support rod rotatably mounted in the receiving space of the platform;

the top cover has a bottom face formed with two opposite second support rails aligning with the two first support rails of the platform respectively;

each of the two second support rails of the top cover has a bottom formed with a second slideway aligning with the first slideway of a respective one of the two first support rails;

the top cover has two opposite sides each formed with a cutout;

the sliding unit includes:

a shaft movably mounted between the base and the top cover and having two opposite ends each extending through and protruding outward from the cutout of the top cover;

a movable rod rotatably mounted on the shaft and received in the receiving space of the platform;

two rollers each rotatably mounted on the shaft and each movable in the first slideway of a respective one of the two first support rails and the second slideway of a respective one of the two second support rails; and two handgrips mounted on the two opposite ends of the shaft respectively and protruding outward from the base and the top cover;

the elastic cord passes through and is wound around the support rod and the movable rod of the sliding unit;

the elastic cord has two distal ends secured on the platform of the base.

2. The abdomen exercising device of claim 1, wherein the base is mounted on a top of the cushion.

3. The abdomen exercising device of claim 1, wherein the base is spaced from the cushion;

the abdomen exercising device further comprises at least one connecting member connected between the base and the cushion to connect the base with the cushion;

the connecting member is made of an elongate weaving strap and has an adjustable length.

4. The abdomen exercising device of claim 1, wherein the support rod is covered by the top cover;

the shaft, the movable rod and the two rollers of the sliding unit are covered by the top cover;

the movable rod, the two rollers and the two handgrips of the sliding unit are spaced from each other;

the movable rod of the sliding unit is disposed between the two first support rails of the platform and between the two second support rails of the top cover;

the two handgrips of the sliding unit protrude outward from the two first support rails of the platform respectively and protrude outward from the two second support rails of the top cover respectively.

5. The abdomen exercising device of claim 1, wherein the first slideway of each of the two first support rails is provided with two opposite stop blocks and two opposite buffer pads mounted on the two stop blocks respectively;

the two buffer pads of each of the two first support rails face toward each other;

each of the two rollers of the sliding unit is limited between the two stop blocks of each of the two first support rails.

6. The abdomen exercising device of claim 1, wherein the base has a bottom provided with two opposite stands to elevate the base.

7. The abdomen exercising device of claim 1, wherein the top cover has two opposite ends each formed with a downward extending sealing plate resting on two opposite ends of the base.

8. The abdomen exercising device of claim 1, wherein the elastic cord is made of a weaving strap.

9. The abdomen exercising device of claim 1, wherein the elastic cord is made of a rubber cord.

10. The abdomen exercising device of claim 1, wherein the movable rod has two opposite ends each rotatably mounted on the shaft by a bearing.

11. The abdomen exercising device of claim 1, wherein the movable rod has a periphery formed with a limit groove;

the elastic cord is wound around the limit groove of the movable rod;

the elastic cord is received in the receiving space of the platform.

12. The abdomen exercising device of claim 1, wherein a first one of the two distal ends of the elastic cord is secured on the platform of the base; and a second one of the two distal ends of the elastic cord is initially wound around the support rod, then wound around the movable rod of the sliding unit, then wound around the support rod and is finally secured on the platform of the base.

13. The abdomen exercising device of claim 1, wherein the abdomen exercising device further comprises a plurality of tension adjusting seats mounted on the platform of the base;

the two distal ends of the elastic cord are adjustably mounted on the tension adjusting seats respectively.

14. The abdomen exercising device of claim 1, wherein the tension adjusting seats are received in the receiving space of the platform;

the tension adjusting seats are spaced from each other with a determined interval defined therebetween to adjust the tension of the elastic cord.

15. The abdomen exercising device of claim 1, wherein each of the tension adjusting seats has a substantially U-shaped profile and has a top formed with an arcuate retaining groove to receive the elastic cord;

each of the two distal ends of the elastic cord is provided with an enlarged head abutting a side of the respective tension adjusting seat;

the enlarged head of the elastic cord has a size greater than that of the retaining groove of the respective tension adjusting seat.

16. The abdomen exercising device of claim 1, wherein the cushion is made of a resilient material so as to provide a shock-absorbing effect;

the cushion is foldable.

* * * * *